US007341232B2

(12) United States Patent
Masas

(10) Patent No.: US 7,341,232 B2
(45) Date of Patent: Mar. 11, 2008

(54) METHODS AND APPARATUS FOR SUSPENDING FIXTURES

(76) Inventor: Fernando R. Masas, 100 Astoria Ave., Bridgeport, CT (US) 06604

( * ) Notice: Subject to any disclaimer, the term of this patent is extended or adjusted under 35 U.S.C. 154(b) by 461 days.

(21) Appl. No.: 10/448,951

(22) Filed: May 30, 2003

(65) Prior Publication Data

US 2003/0222190 A1 Dec. 4, 2003

Related U.S. Application Data

(60) Provisional application No. 60/384,675, filed on May 31, 2002.

(51) Int. Cl.
*B42F 13/00* (2006.01)

(52) U.S. Cl. ..... 248/342; 248/58; 248/65

(58) Field of Classification Search ..... 248/317, 248/58, 342, 343, 300, 301, 304, 305, 65, 248/68.1, 74.2, 74.1
See application file for complete search history.

(56) References Cited

U.S. PATENT DOCUMENTS 2,297,802 A * 10/1942 Sachs ..... 174/161 F
2,672,314 A * 3/1954 Mitchell ..... 248/301
3,931,950 A * 1/1976 Javillonar ..... 248/108
4,227,876 A * 10/1980 Fogel et al. ..... 433/11
4,714,218 A * 12/1987 Hungerford, Jr. ..... 248/62
5,178,503 A * 1/1993 Losada ..... 411/441
5,184,792 A * 2/1993 Bernhard et al. ..... 248/71
5,346,166 A * 9/1994 Valiulis ..... 248/220.41
5,369,225 A * 11/1994 Natwig et al. ..... 174/84 R
5,393,932 A * 2/1995 Young et al. ..... 174/84 R
5,742,987 A * 4/1998 Mikulec et al. ..... 24/641
5,749,479 A * 5/1998 Belokin et al. ..... 211/113
5,754,994 A * 5/1998 Soper ..... 5/100
5,975,498 A * 11/1999 Sauner ..... 254/323
6,026,545 A * 2/2000 Duggan ..... 24/265 AL
6,126,493 A * 10/2000 Price et al. ..... 439/801
6,209,853 B1 * 4/2001 Roy et al. ..... 256/10
6,382,569 B1 * 5/2002 Schattner et al. ..... 248/74.1
6,544,056 B1 * 4/2003 Roth et al. ..... 439/161
6,599,137 B2 * 7/2003 Modina ..... 439/92

* cited by examiner

*Primary Examiner*—Carl D. Friedman
*Assistant Examiner*—Steven Marsh
(74) *Attorney, Agent, or Firm*—Thomas A. Gallagher

(57) ABSTRACT

Various systems including brackets and associated wires are disclosed for suspending fixtures from ceilings and the like. The systems improve over the prior art in several ways. Attachment of the wire to the bracket is faster and easier. The attachment can be made more rigid. Several different components can be combined to adapt to different suspension requirements. Brackets can be provided with structure to make more stable connections to cement and masonry.

5 Claims, 12 Drawing Sheets

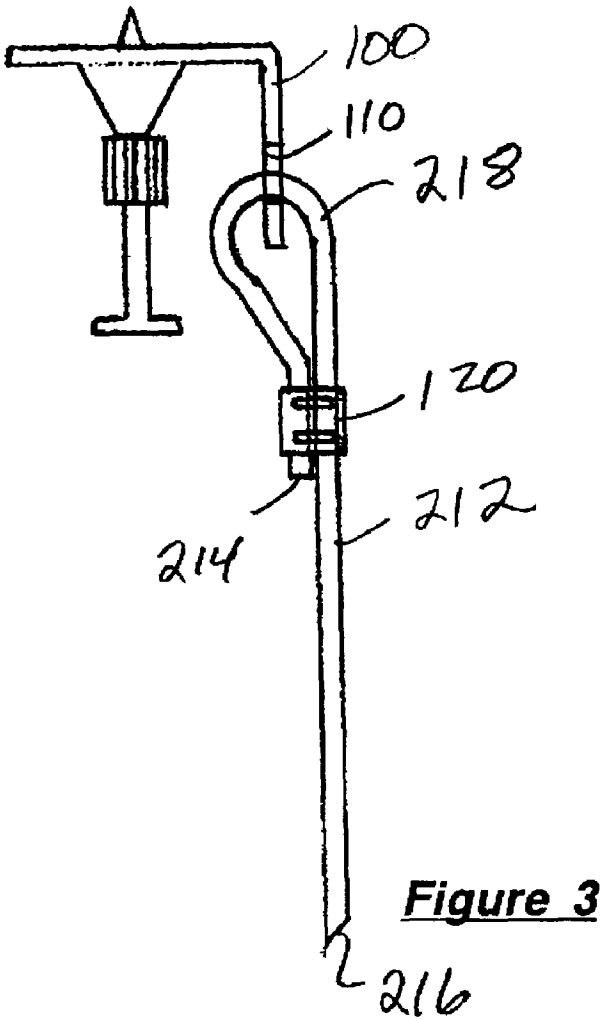
Figure 3
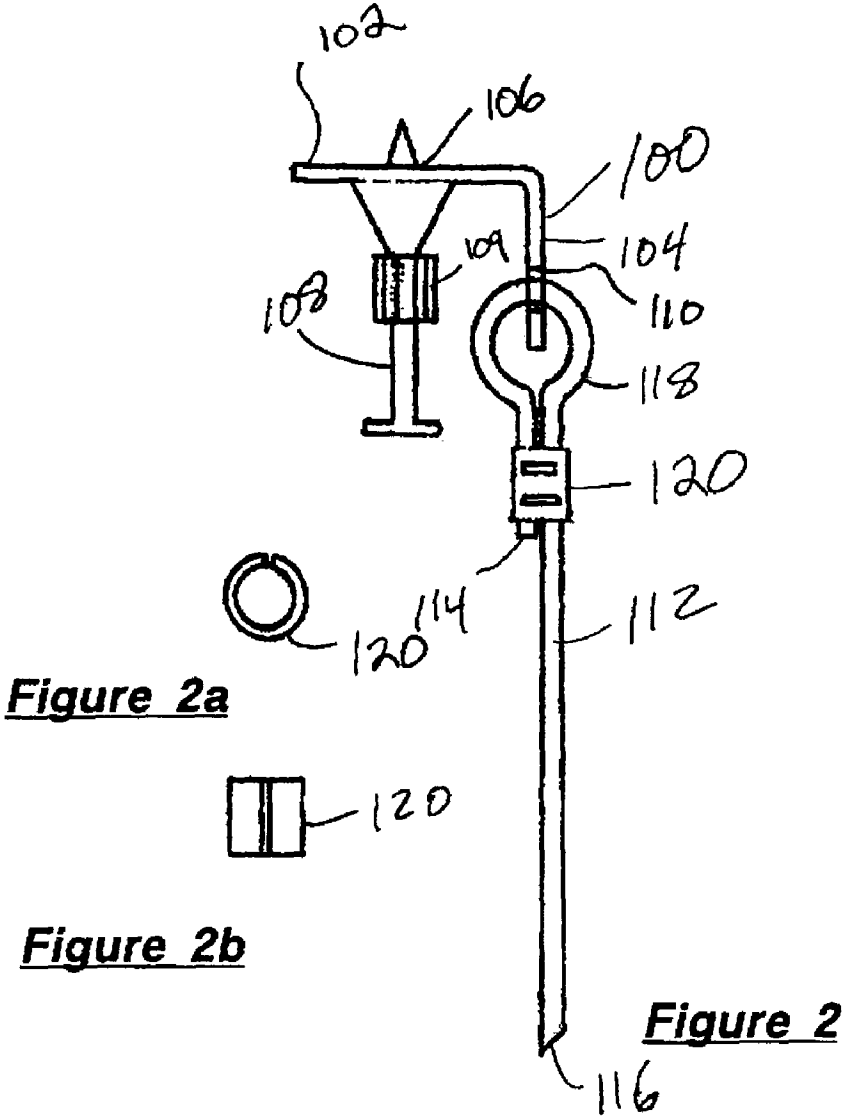
Figure 2
Figure 2a
Figure 2b

METHODS AND APPARATUS FOR SUSPENDING FIXTURES

This application claims the benefit of provisional application Ser. No. 60/384,675 filed May 31, 2002.

This application is a continuation-in-part of my prior application Ser. No. 10/092,741 filed Mar. 7, 2002, the complete disclosure of which is hereby incorporated by reference herein. This application is also a continuation-in-part of my prior application Ser. No. 10/134,229 filed Apr. 26, 2002, the complete disclosure of which is hereby incorporated by reference herein.

BACKGROUND OF THE INVENTION

1. Field of the Invention

The invention relates to mechanical fasteners. More particularly, the invention relates to mechanical fasteners suitable for suspending fixtures such as acoustic tile ceilings, pipes, lighting fixtures, electrical cables, HVAC equipment etc.

2. State of the Art

Current practice in the construction trade and building industry is to suspend fixtures with wires which are fastened to a wall or ceiling. An example of a state of the art apparatus for suspending fixtures is illustrated in prior art FIG. 1. The apparatus generally includes an angle bracket 10 having two holes 12, 14, a fastener 16 (typically a nail or a screw), and a length of wire 18 (often six to eight feet long). The method for using the apparatus includes attaching the wire 18 through one of the holes 14, inserting the fastener 16 through the other hole 12, and fastening the fastener 16 to a wall or ceiling 20. An exemplary bracket and fastener are illustrated in U.S. Pat. Nos. 5,178,503 and 4,736,923.

The apparatus shown in FIG. 1 is often used to suspend fixtures from cement, stone, or other masonry material ceilings, typically in commercial buildings. The wires 18 are attached to ceiling tile grids, pipe brackets, HVAC ducts, lighting fixtures, etc. Because a relatively large variety of equipment is hidden above a suspended acoustic tile ceiling in a commercial building, the wires 18 are often six to eight feet long.

The fastener 16 is usually pre-fit into the hole 12 of the bracket 10 during manufacture. However, the wire 18 (usually 12 gauge galvanized steel) must be manually attached to the bracket 10 by inserting a free end of the wire through the hole 14, looping the wire onto itself and twisting it as shown in FIG. 1. This is often done by hand with a pair of pliers or may be done with the aid of a hand operated (or drill operated) crank such as the "wire tying fixture", item number 00052075, sold by Hilti, Inc., Tulsa, Okla. These methods of attaching the wire to the bracket present several disadvantages.

The most apparent disadvantage is the cost of labor for the labor intensive task of twisting the wire. In order to be reasonably secure and satisfy some municipal codes, approximately eight inches of the wire must be twisted eight to ten turns about itself. In practice, many workers only twist the wire three or four times about itself. Still, the work is time consuming. The best productivity is not much more than about 300 pieces per hour and after about 500 pieces the worker needs to rest.

Another disadvantage is that this method of connecting the wire to the bracket is not very secure. Under a stress of about 50 lbs., the wire loop stretches and under a stress of about 210 lbs. the wire untwists.

Still another disadvantage is that the connection between the wire and the bracket is loose. Under normal circumstances, gravity provides tension between the wire and the bracket. However, in the case of an earthquake or a fire, the loose connection between the wire and the bracket allows vibration and movement of the fixtures supported by the wire. This can result in fixtures falling onto emergency workers and other similar hazards.

Yet another disadvantage is that if the bracket becomes damaged, the wire attached to it is usually wasted. For example, many brackets are manufactured with fasteners pre-attached so that the bracket may be installed quickly without holding both the bracket and fastener in place. If the fastener detaches from the bracket after the wire is attached but before the bracket is installed, or if the fastener fails to fasten properly, the bracket with the attached wire is typically discarded, thus wasting the wire.

It is estimated that the annual sale of brackets and wires is in excess of one hundred million. It is also estimated that the failure rate is 12-20%. The average wire length is six feet. Thus, approximately 72-120 million feet of wire goes to waste.

My first prior application, referenced above, discloses an angle bracket with a hole for a fastener and a flange for coupling a wire to the angle bracket. The flange is lanced and it is coupled to the wire by crimping. According to a first embodiment, the flange is provided with two horizontal lances. According to a second embodiment, the flange is provided with at least three alternating horizontal lances. According to a third embodiment, the flange is provided with a horizontal lance and a vertical lance. According to a fourth embodiment, the flange is provided with a vertical lance in the shape of a hook and an eyelet is provided for connecting the wire. According to a fifth embodiment, the flange is wrapped to form a slotted cylinder. The wire is inserted into the slotted cylinder which is then compressed and crimped onto the wire. According to a sixth embodiment, the angle bracket is provided with two wire connecting flanges. A seventh embodiment is similar to the sixth embodiment with features of the second embodiment. A kit is also disclosed which includes a plurality of lanced angle brackets, a plurality of pre-cut lengths of wire, and a combined crimping and testing tool.

My second prior application, referenced above, discloses an angle bracket with a hole for a fastener and a flange with a hole for receiving a wire and a wire with a deformation or attachment at one end which prevents it from passing completely through the hole in the flange of the bracket. Six embodiments of a bracket are disclosed. Eight embodiments of a wire are disclosed. The wires may be used with prior art brackets with little or no modification to the bracket. An unmodified prior art bracket is shown in conjunction with wires according to the invention and a slightly modified prior art bracket is shown with a wire according to the invention.

Although the methods and apparatus disclosed in my prior applications are improvements over the prior art, it is my intention to provide yet additional methods and apparatus which overcome disadvantages of the prior art.

SUMMARY OF THE INVENTION

It is therefore an object of the invention to provide improved methods and apparatus for suspending fixtures.

It is also an object of the invention to provide methods and apparatus for suspending fixtures which are not labor intensive.

It is another object of the invention to provide methods and apparatus for suspending fixtures which are more economical than the state of the art.

It is still another object of the invention to provide methods and apparatus for suspending fixtures which are safer and stronger than the state of the art.

It is yet another object of the invention to provide methods and apparatus for suspending fixtures which provide brackets and wires which are easily coupled and uncoupled.

In accord with these objects which will be discussed in detail below, the apparatus of the present invention includes an angle bracket with a hole for a fastener and a hole for coupling a wire to the angle bracket. Wires according to one aspect of the invention include a collar for forming a loop through the hole in the angle bracket. Three embodiments of wires with collars are disclosed. According to one embodiment, the collar is a slotted cylinder which is crimped to the wire at the time it is attached to the bracket. According to a second embodiment, the collar is crimped to the wire at the factory and has a J-shaped extension which allows the end of the wire to be engaged by the collar in a manner similar to a safety pin. According to a third embodiment, the collar is made of a loop of wire which is twisted several times at the time it is attached to the bracket. Wires according to another aspect of the invention are provided in two parts with a crimpable structure for joining the wires. According to this aspect of the invention, the length of the wire assembly can be adjusted without cutting wire. A new angle bracket according to the invention includes a tongue formed by lancing. The tongue prevents wire from escaping. Three other embodiments of wires and brackets following from my second previous application are also disclosed. According to another aspect of the invention, a wire is provided with two bends at one end which may be slipped through the wire-receiving hole of a conventional bracket and hooked upon itself.

Additional objects and advantages of the invention will become apparent to those skilled in the art upon reference to the detailed description taken in conjunction with the provided figures.

BRIEF DESCRIPTION OF THE DRAWINGS

FIG. 2 is a partially transparent schematic side elevational view of a first embodiment of the invention;

FIG. 2*a* is a top plan view of the collar of the first embodiment;

FIG. 2*b* is a rear side elevational view of the collar of the first embodiment;

FIG. 3 is a view similar to FIG. 2 with a slightly different loop in the wire;

DETAILED DESCRIPTION OF THE PREFERRED EMBODIMENTS

Figure 1:
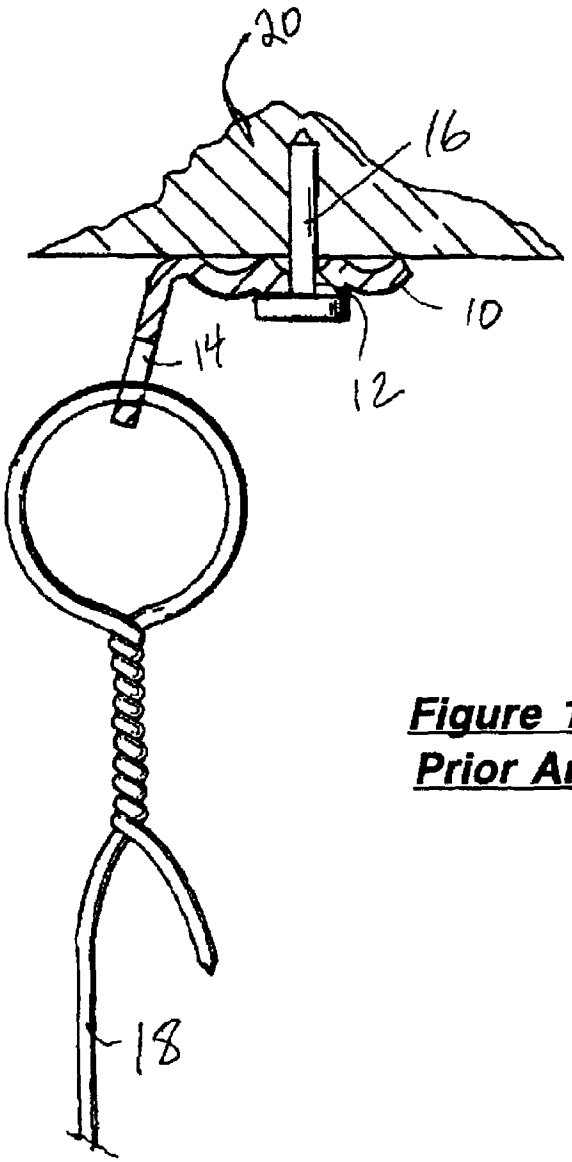
Figure 1 Prior Art
FIG. 1 is a schematic side elevational view, in partial section, of a state of the art apparatus for suspending fixtures.

Referring now to FIGS. 2, 2*a*, and 2*b*, a first embodiment of the invention is illustrated with a conventional angle bracket fastener 100. The angle bracket 100 has a first flange 102 and a second substantially orthogonal flange 104. The first flange 102 has a first hole 106 for receiving a fastener such as the nail 108. As illustrated, the nail 108 is pre-mounted in the hole 106 and is provided with a collar 109 which facilitates aiming and firing the nail with a gun (not shown). The flange 104 is provided with a hole 110 for receiving a wire.

The wire 112 according to the invention has a first end 114 and a second end 116. Though illustrated as a short wire, the wire 112 is typically six feet or longer. The wire 112 is preferably provided with a loop 118 so the end 114 comes adjacent to an earlier portion of the wire. According to the invention, a crimpable collar 120 is provided. The collar 120 is substantially cylindrical and is preferably a slotted cylinder as shown in FIGS. 2*a* and 2*b*. According to a method of the invention, after the loop 118 is formed and the end 114 is passed through the hole 110 in the flange 104, the collar 120 is slipped over the end 114 and the adjacent portion of the wire 112 and is then crimped.

According to the first embodiment of the invention, the wire 112 is pre-formed with the loop 118. The loop is passed through the hole 110 on-site and the collar is also applied and crimped on-site. However, the wire with the collar could be attached to the bracket at the factory if desired.

FIG. 3 shows a slightly different version of the first embodiment. Here the wire 212 has slightly different shaped loop 218. From the foregoing described FIGS. 2 and 3, those skilled in the art will appreciate that the loop at the end of the wire need not be preformed. According to an alternate method of the invention, an on-site worker is provided with brackets, wires, collars, and a crimping tool. The on-site worker threads and loops a wire onto a bracket, slips the collar over the wire and crimps the collar to achieve a configuration similar to that shown in FIGS. 2 and/or 3.

Figure 5:
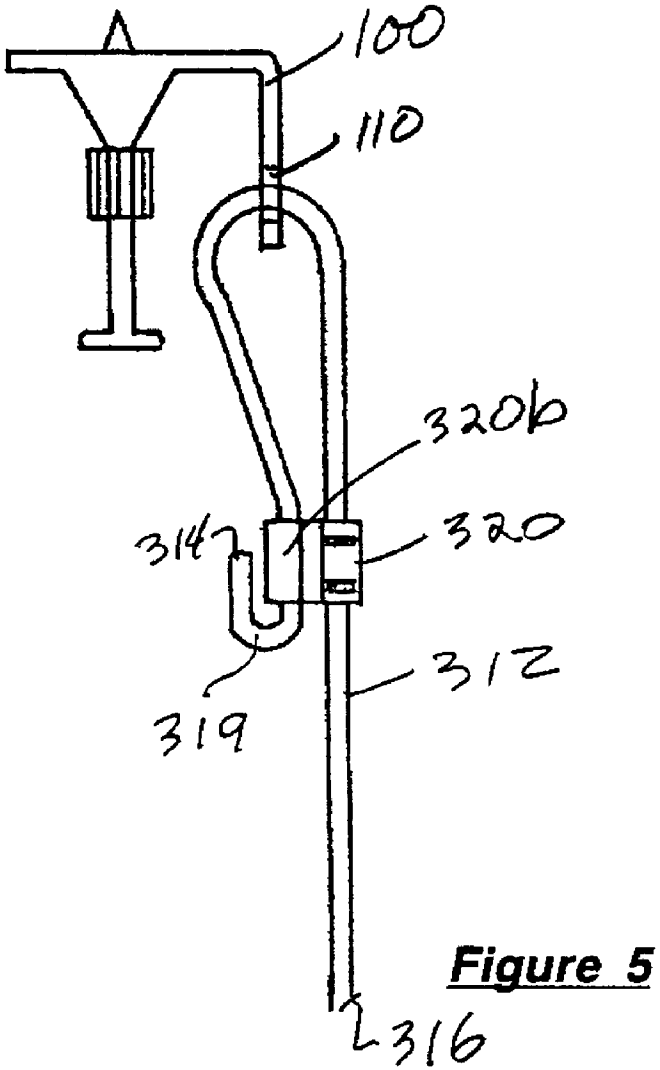
FIG. 5 is a view similar to FIG. 4 showing the wire fully engaged by the collar.
Figure 4:
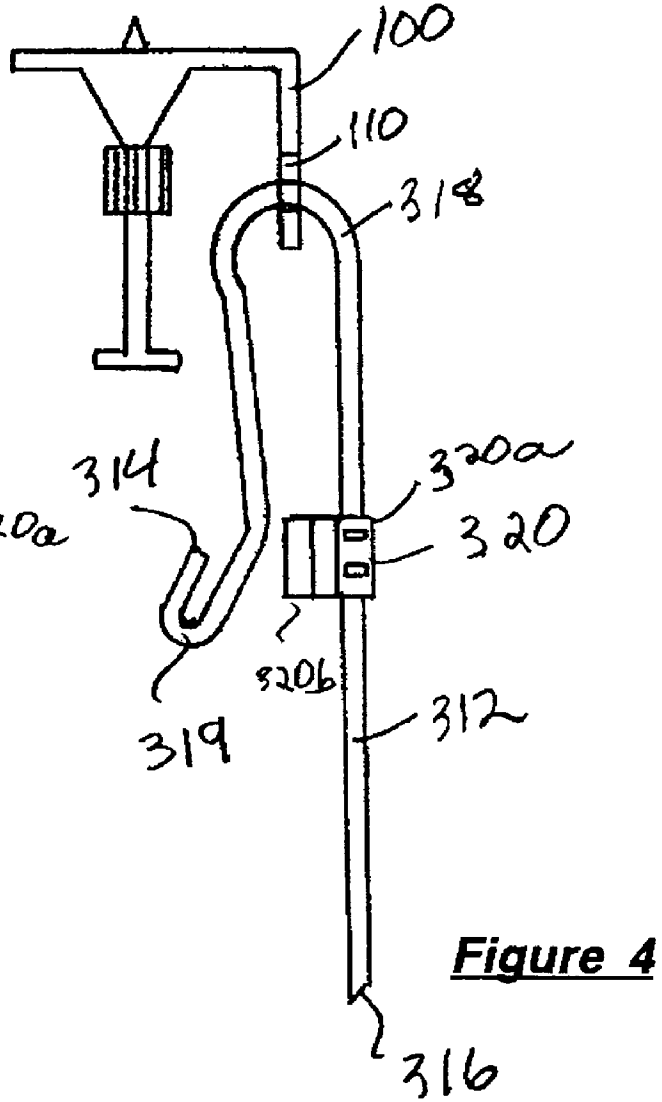
FIG. 4 is a partially transparent schematic side elevational view of a second embodiment of the invention, partially assembled.
Figure 4A:
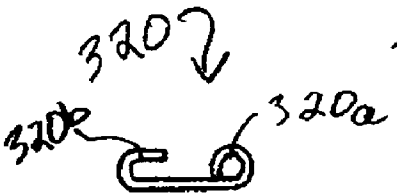
FIG. 4*a* is a bottom plan view of the collar of the second embodiment.

FIGS. 4, 4*a* and 5 illustrate a second embodiment of a wire with a collar for use with a prior art angle bracket 100. The wire 312 has a first end 314 and a second 316. A loop 318 is formed near the end 314 and a substantially "g-shaped" collar is attached to the wire before the loop 318. The collar has a closed portion 320*a* which is crimped to the wire 312 and a substantially "J-shaped" open portion 320*b* which extends outward. As shown in FIGS. 4 and 5, the end 314 is provided with a substantially 180° bend 319, thus imparting it with a J-shape as well. As shown in FIG. 5, a portion of the wire before the bend 319 is captured by the open portion 320*b* in a manner similar to that of a safety pin. Thus, it will be appreciated that the bend 319 is optional.

According to this embodiment, the bend 318 and optionally 319 are formed in the factory where the collar 320 is crimped to the wire. The on-site worker can then insert the end 314 through the hole 110 in the clip 100 and fasten the wire by engaging the end in the open portion 320*b* of the collar 320.

Figures 6, 6A:
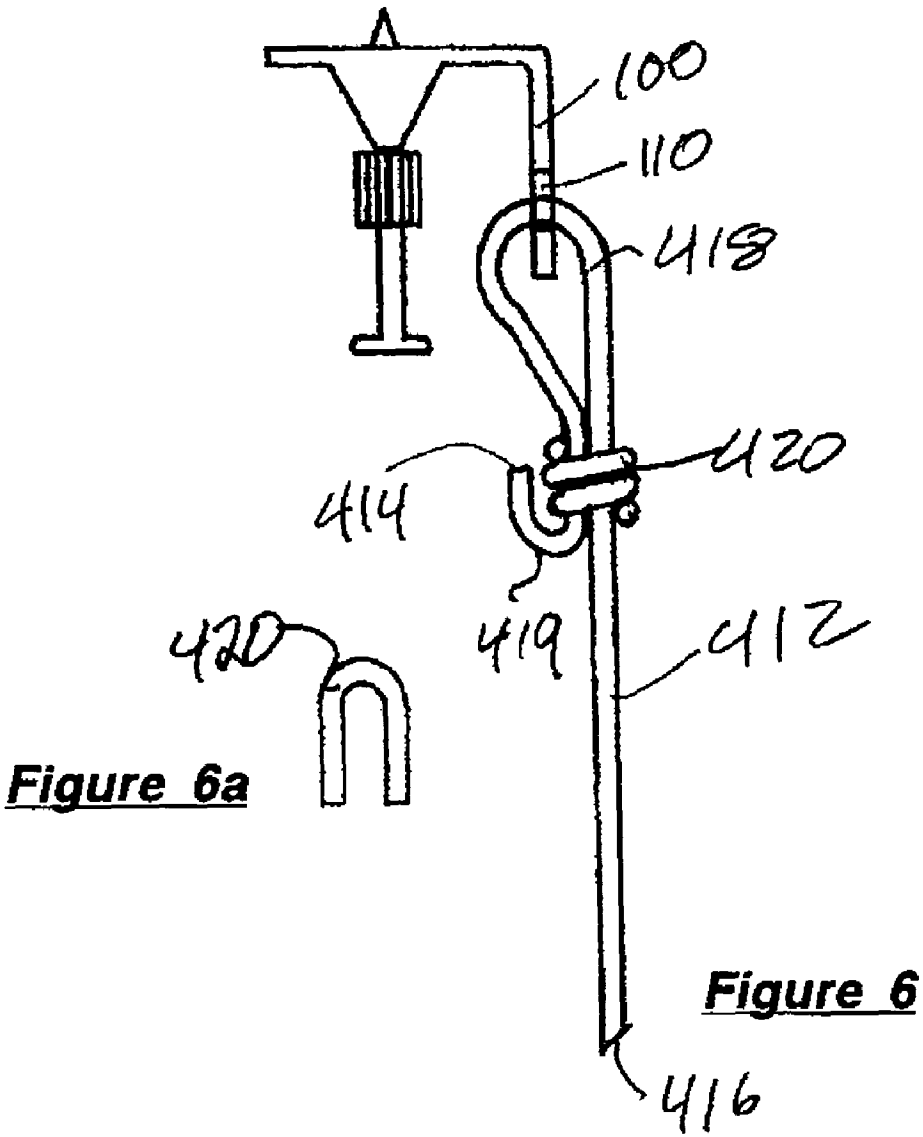
FIG. 6 is a partially transparent schematic side elevational view of a third embodiment of the invention, partially assembled.
FIG. 6*a* is a plan view of the wire used to form the collar of the third embodiment.

FIGS. 6 and 6*a* illustrate an embodiment similar to that shown in FIGS. 4 and 5 but where the collar is formed by a twisted wire. As shown in FIG. 6, the wire 412 has a first end 414, a second end 416 and two bends 418 and 419 similar to the wire 312. Here the area of the wore adjacent the bend 319 is secured to an area before the bend 318 by a twisted wire 420. The wire 420 is preferably applied with a twisting device (not shown).

Figure 8:
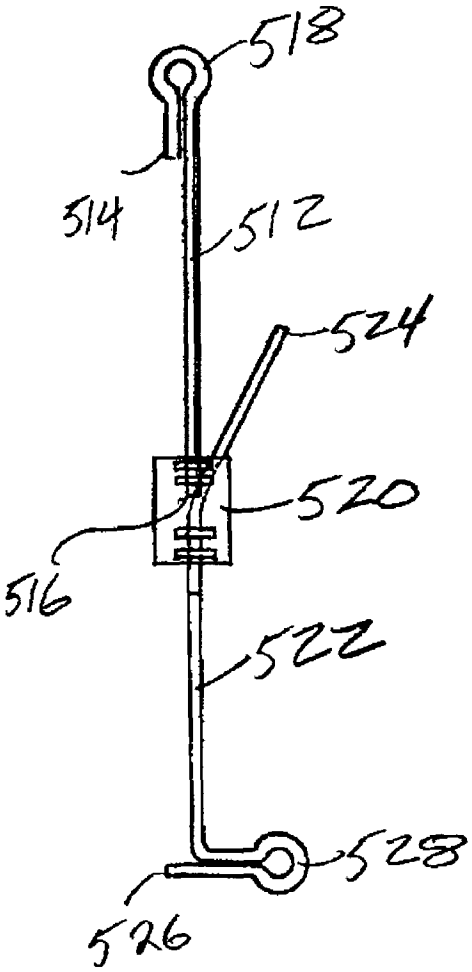
FIG. 8 illustrates the two part wire assembly without the bracket and hanging structure.
Figure 7:
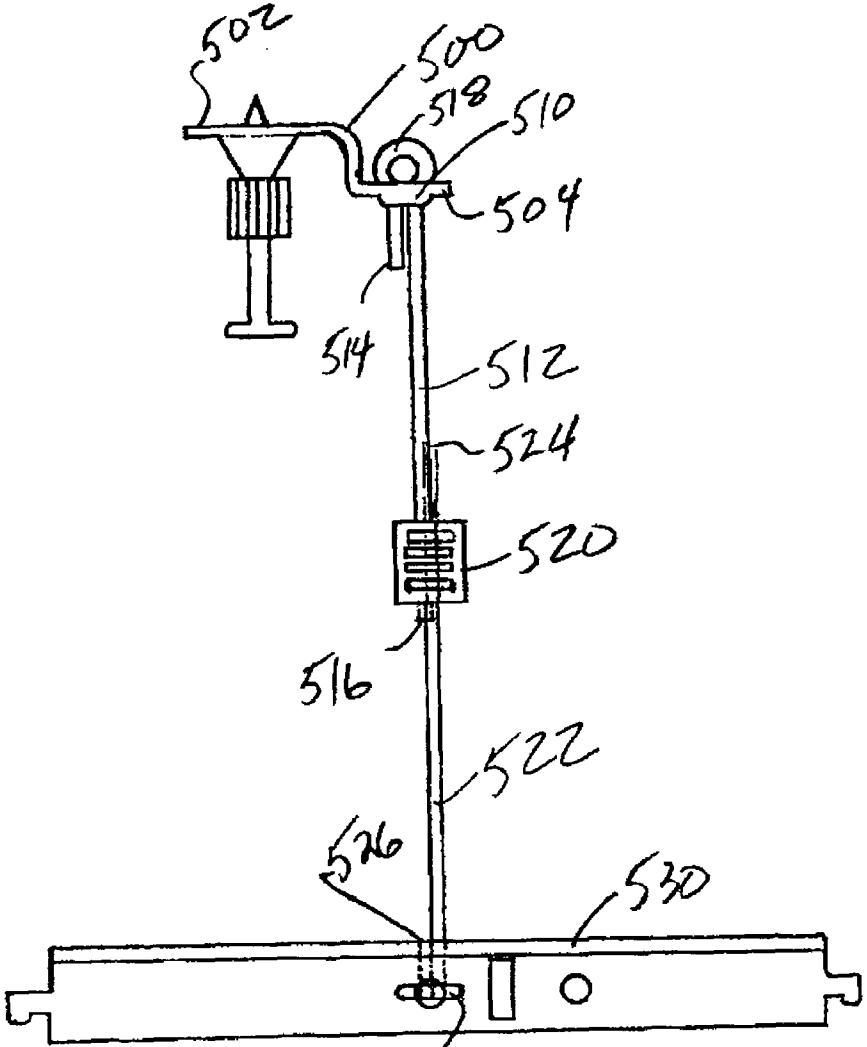
FIG. 7 illustrates an embodiment of a two part wire assembly according to the invention in conjunction with a bracket and a hanging structure.

FIGS. 7 and 8 illustrate a two part wire assembly which can be adjusted lengthwise on-site without cutting wire. As shown in FIG. 7, a bracket 500 of the type disclosed in my second parent application includes two parallel flange 502, 504 with a bowl-like hole 510 in the second flange 504. A first wire 512 has a first end 514, a second end 516 and a loop 518 formed near the first end 514. The loop 518 prevents the wire from passing completely through the hole 510. A second similar wire 522 is provided having a first end 524, a second end 526, and a loop 528 near the second end 526. The loop 528 is used to engage a hole in a hanging structure 530 such as a frame for an acoustic tile ceiling or the like. According to this embodiment of the invention, the first wire 512 and the second wire 522 are coupled to each other by a crimpable collar 520. As shown in FIGS. 7 and 8, the collar 520 is a sheet of metal which has been lanced in several places to provide two openings for receiving the wires. This type of lancing is shown and described in my first parent application, previously incorporated hereinabove. Those skilled in the art will appreciate that it will be advantageous to lance in one direction for one wire and in the other direction for the other wire so that the wires pass on opposite sides of the metal sheet. When the two wires are inserted into the collar 520, they can be moved longitudinally so as to adjust the overall length of the two wire and collar assembly. According to a method of the invention, the collar 520 is crimped to the upper wire 512 and the lower wire 522 is moved through the collar. When the overall length of the wire assembly is decided, the lower wire 522 can be bent slightly as shown in FIG. 8 to maintain its position temporarily while the collar 520 is crimped to it.

Figures 9, 10, 11, 12:
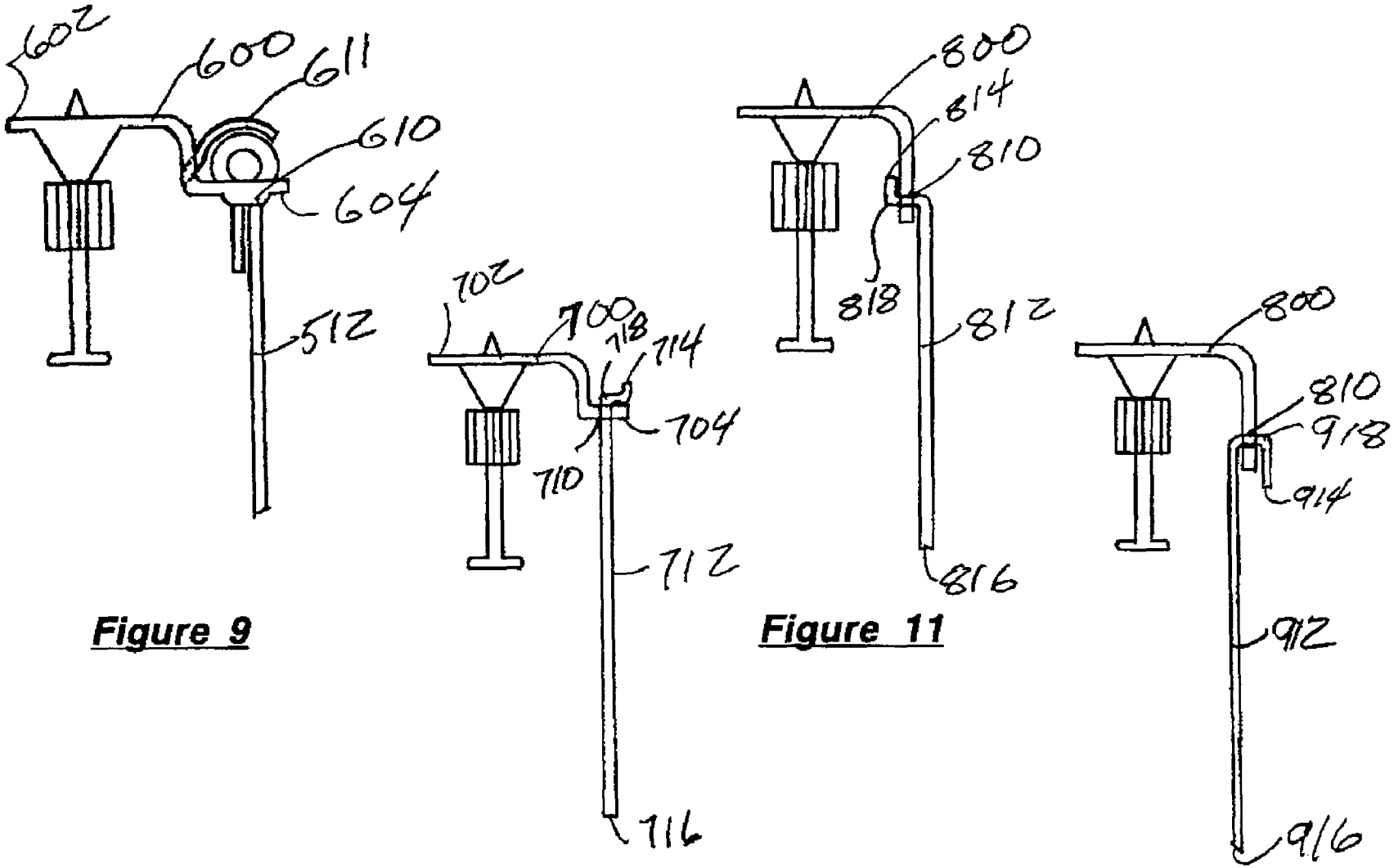
FIG. 9 illustrates an embodiment of an angle bracket with a tongue.
FIGS. 10-12 illustrate alternate embodiments of a wire and bracket structure as described in my second parent application.

FIG. 9 illustrates an angle bracket 600 having a tongue 611. The angle bracket 600 is similar to those described in my second parent application, having an upper flange 602 and a substantially parallel lower flange 604. The lower flange 604 is provided with a bowl-like hole 610 which receives and captures the upper loop of a wire 512. According to this embodiment, a portion of the bracket 600 (above the lower flange) is lanced to create a tongue 611 which can be bent down on top of the loop in wire 512 to prevent the wire from escaping the bracket. Those skilled in the art will appreciate that the tongued bracket can be used with several of the different wire embodiments disclosed in my second parent application.

FIGS. 10-12 illustrate wires of the type discussed in my second parent application but where the deformation at the upper end of the wire is relatively small and thus requires the use of a bracket with a wire hole not too much larger than the diameter of the wire.

FIG. 10 illustrates a wire 712 in conjunction with a bracket 700 having two parallel flanges 702, 704 similar to those described in my second parent application. The bracket 700 has a wire-receiving hole 710 in the second flange 704. The diameter of the whole 710 is preferably only large enough to allow the wire 712 to pass through without difficulty. The wire 712 has a first end 714 and a second end 716. The first end 714 is provided with a deformation 718, in this case a Z-bend, which allows the first end of the wire to be passed carefully through the hole 710 but which prevents the wire from passing back out when the bracket 700 and wire 712 are in hanging relationship as shown in FIG. 10.

FIG. 11 illustrates a wire 812 in conjunction with a bracket 800 which is similar to a prior art bracket. The bracket 800 has a wire-receiving hole 810 with a diameter preferably only large enough to allow the wire 812 to pass through without difficulty. The wire 812 has a first end 814 and a second end 816. The first end 814 is provided with a deformation 818, in this case a Z-bend, which allows the first end of the wire to be passed carefully through the hole 810 but which prevents the wire from passing back out when the bracket 800 and wire 812 are in hanging relationship as shown in FIG. 11.

FIG. 12 illustrates a wire 912 in conjunction with a bracket 800 which is similar to a prior art bracket. The bracket 800 has a wire-receiving hole 810 with a diameter preferably only large enough to allow the wire 812 to pass through without difficulty. The wire 912 has a first end 914 and a second end 916. The first end 914 is provided with a deformation 918, in this case a U-bend, which allows the first end of the wire to be passed carefully through the hole 810 but which prevents the wire from passing back out when the bracket 800 and wire 912 are in hanging relationship as shown in FIG. 12.

Figure 14:
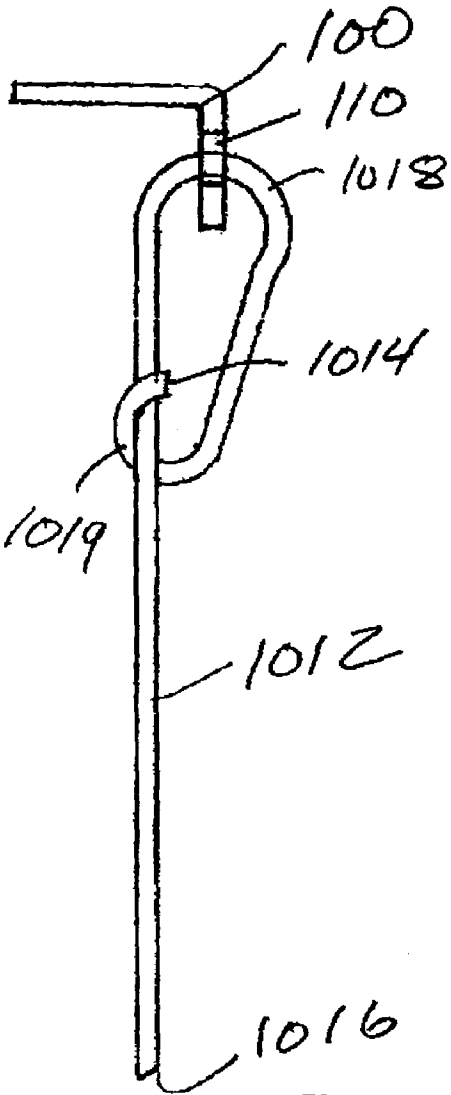
FIGS. 13 and 14 illustrate a wire similar to the wire illustrated in FIG. 6 but configured to hook onto itself without a collar.
Figure 13:
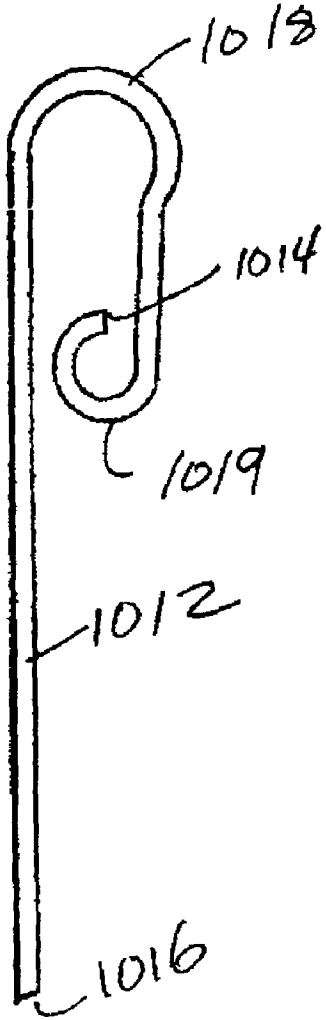

FIGS. 13 and 14 illustrate a wire 1012 which may be used with any conventional bracket 100. The wire 1012 has a first end 1014 and a second end 1016. The first end of the wire is provided with two bends 1018 and 1019. The bends are configured so that the wore may be passed through the hole 110 in a conventional bracket 100 and then hooked onto itself as illustrated in FIG. 14.

Figure 16:
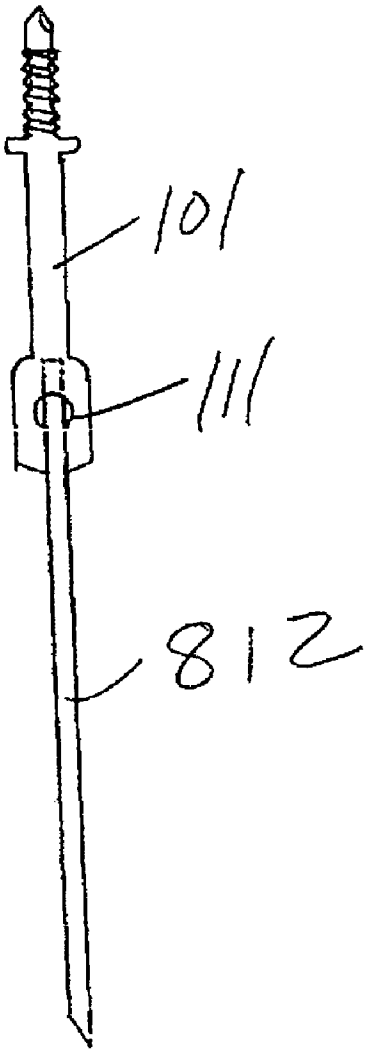
FIGS. 15 and 16 illustrate the wire of FIG. 11 with a modified prior art bracket.
Figure 15:
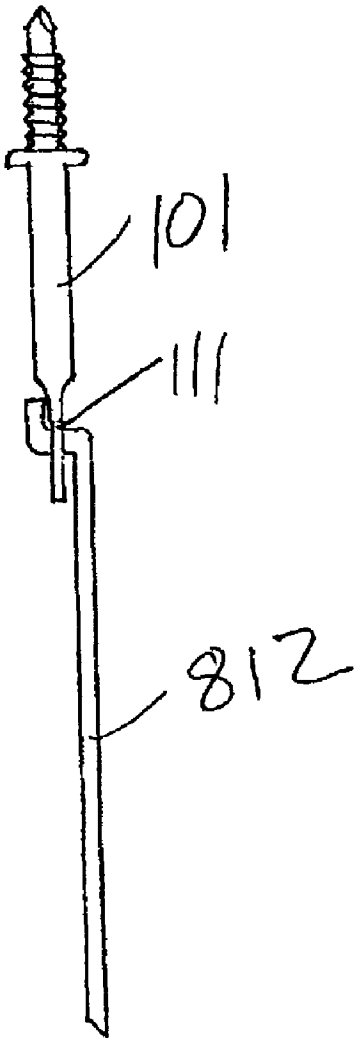

FIGS. 15 and 16 illustrate the wore 812 with a modified prior art bracket 101. The only modification to the bracket is the diameter of the hole 111 which is made closer to the diameter of the wire 812.

Figure 17:
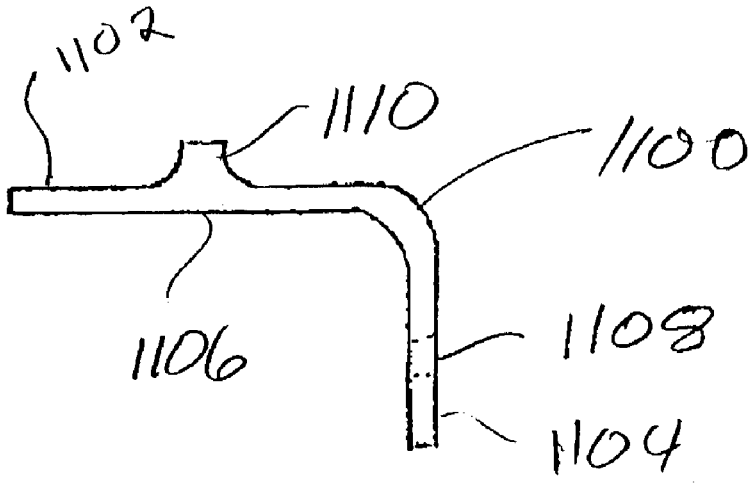
FIG. 17 illustrates an angle bracket having an extruded funnel.
Figure 18:
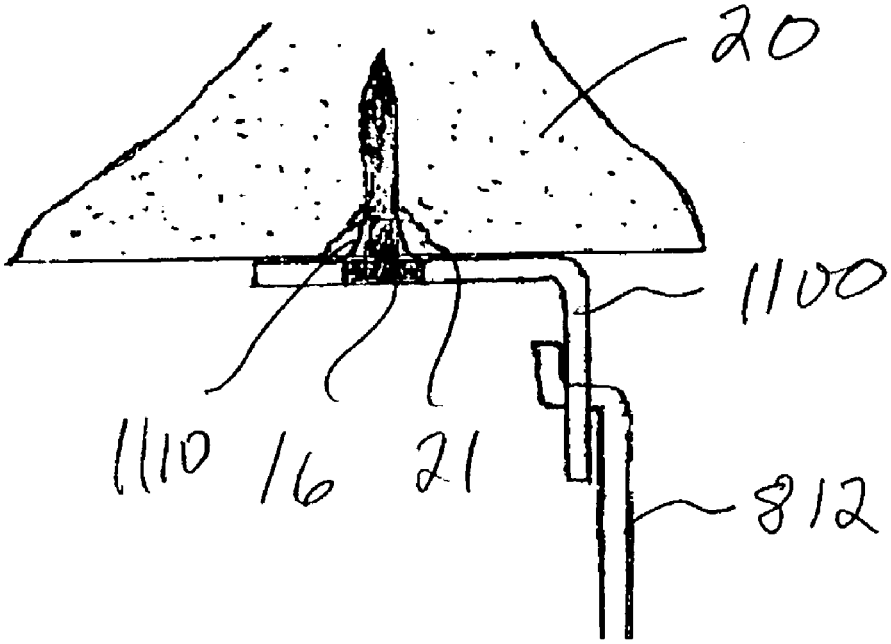
FIG. 18 illustrates the angle bracket of FIG. 17 installed with a nail in a cement ceiling.

Turning now to FIGS. 17 and 18, an angle bracket 1100 according to the invention has a first end 1104 and a second end 1104, a hole for receiving a nail 16 and a hole 1108 for receiving wire 812. The nail receiving hole 1106 is provided with a funnel-like structure 1110 which will fill in the cavity 21 normally formed in cement 20 by the nail 16.

Figure 19:
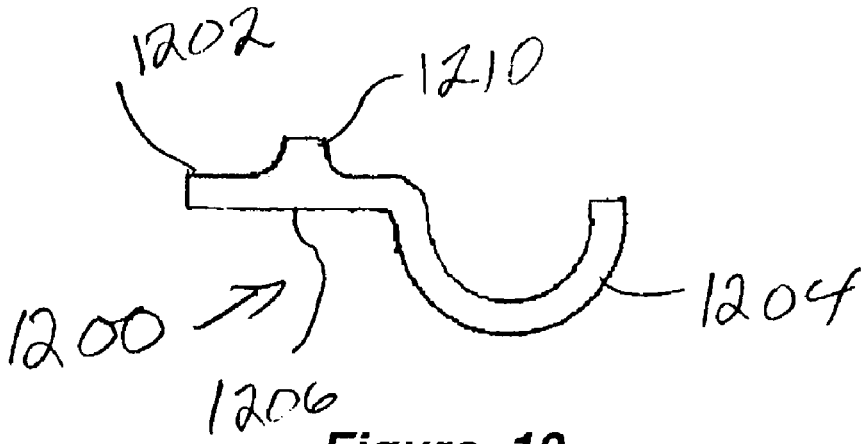
FIG. 19 illustrates a bracket similar to FIG. 17 but designed to secure a conduit or cable.

FIG. 19 illustrates a bracket 1200 having a first end 1202, a second end 1204, a nail receiving hole 1206 and a funnel-like structure 1210 substantially the same as the funnel-like structure 1110 described above. The end 1204 of this bracket is designed to hold a conduit or cable (not shown).

Figure 20:
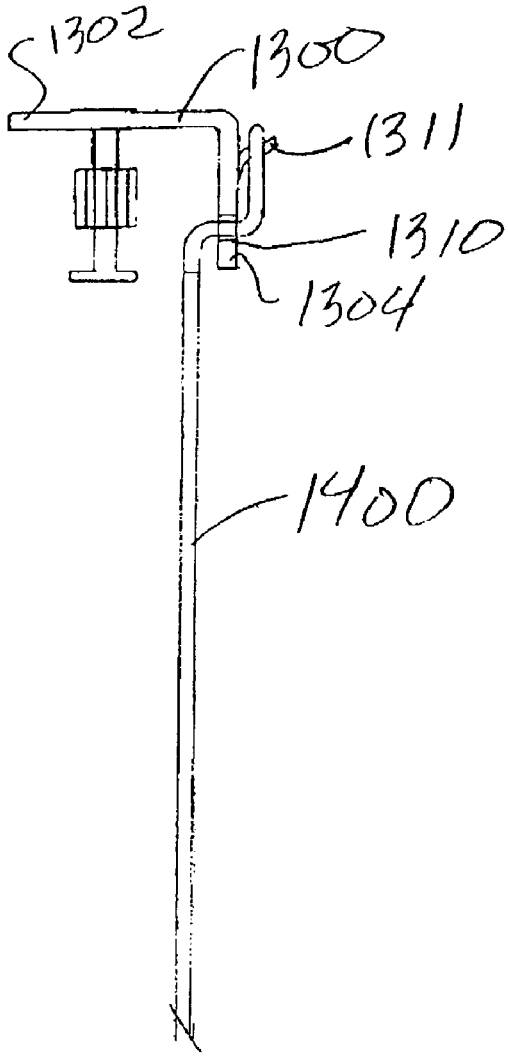
FIG. 20 illustrates an angle bracket having a tongue for engaging the loop of a wire.
Figure 21:
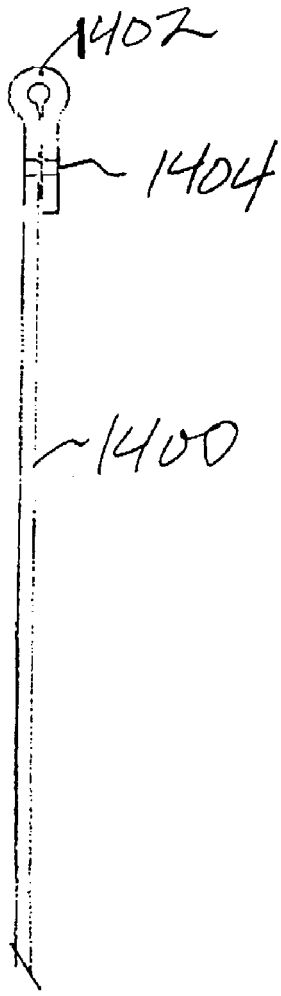
FIG. 21 illustrates the looped wire used with the bracket of FIG. 20.

FIGS. 20 and 21 illustrate a bracket 1300 and wire 1400 which are designed to engage each other in a secure manner so that little or no movement of the wire relative to the bracket is permitted. The bracket 1300 has first and second ends 1302, 1304, a wire receiving hole 1310 and a wire engaging tongue 1311. The wire 1400 has a loop 1402 at one end. The loop 1402 is dimensioned to be engaged by the tongue 1311 as shown in FIG. 20. The wire 1400 is also provided with a z-bend 1404 adjacent to the loop so that the wire may pass through the hole 1310 in the bracket 1300 as shown in FIG. 20.

Figure 22:
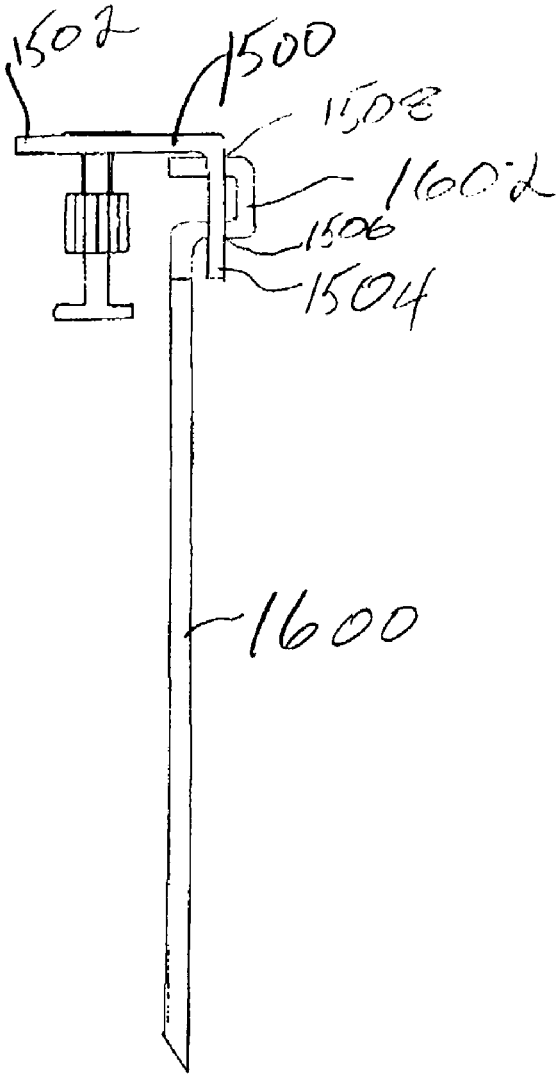
FIG. 22 illustrates an angle bracket having a pair of slots for engaging a hook shaped wire.

FIG. 22 shows a bracket 1500 designed for use with a wire 1600 having a hooked end 1602. As shown in FIG. 22, the hooked end 1602 is formed by three ninety degree bends in the wire. The bracket 1500 has a first end 1502, a second end 1504, and is provided with two holes 1506, 1508 adjacent to the second end 1504.

Figure 23:
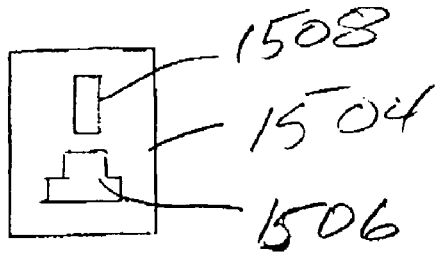
FIG. 23 illustrates one embodiment of the bracket of FIG. 22.

According to one embodiment, shown in FIG. 23, the bottom hole 1506 is shaped like an inverted T and the top hole is a vertical slot. Those skilled in the art will appreciate that the holes and the wire are advantageously dimensioned such that it is possible to position the wire horizontally to pass through the lower horizontal par of the hole 1506. The holes and the wire are also advantageously dimensioned such that when the wire and bracket are assembled as shown in FIG. 22, the lower horizontal par of the hook 1602 is engaged in the vertical portion of the inverted T slot 1506. This arrangement restricts movement of the wire relative to the bracket.

Figure 24:
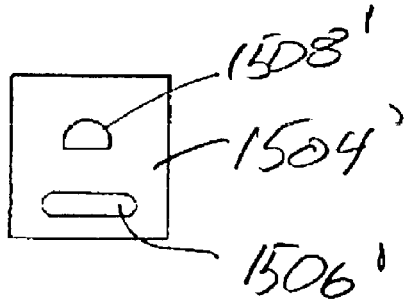
FIG. 24 illustrates another embodiment of the bracket of FIG. 22.

According to a second embodiment, shown in FIG. 24, the bottom hole 1506' is a horizontal slot and the upper hole 1508' is substantially semi-circular. Those skilled in the art will appreciate that the wire can be hooked into the bracket following the same steps as the first embodiment. It will further be appreciated that the dimensions of the hole 1508' may be chosen to allow rotation of the wire and the length of the slot 1506' may be chosen to set the limits of rotational movement of the wire. Alternatively, by providing the wire with a substantially semi-circular cross section and properly dimensioning the hole 1508', rotational movement of the wire relative to the bracket can be minimized or eliminated.

Figure 26:
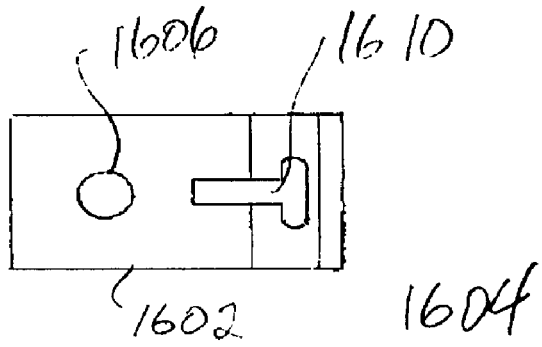
FIG. 26 is a top view of the bracket of FIG. 25.
Figure 25:
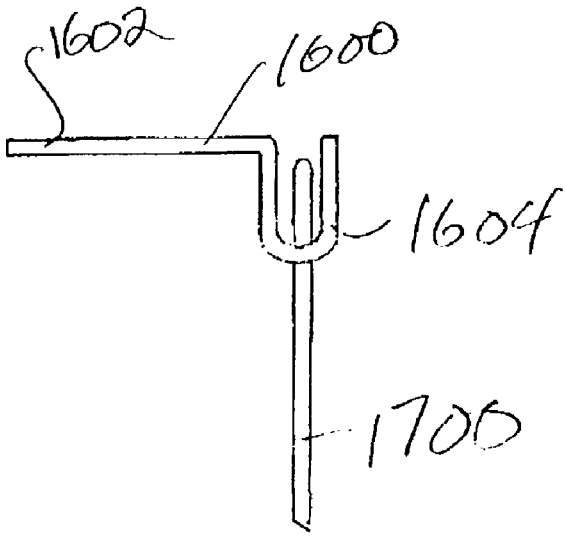
FIG. 25 illustrates an angle bracket for use with a wire having a T-shaped end.
Figure 27:
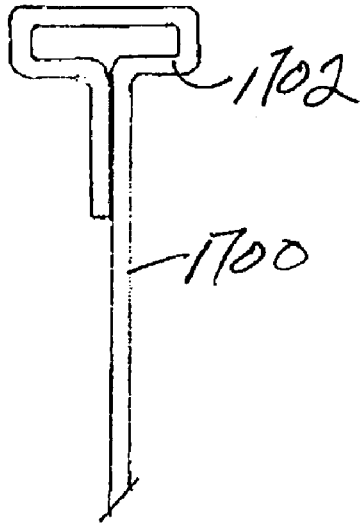
FIG. 27 is a broken side elevational view of a wire with a T-shaped end.

FIGS. 25-27 illustrate a bracket and wire combination which are easy to assemble and which limits movement of the wire relative to the bracket when assembled. The bracket 1600 has a straight flange 1602 coupled to a U-shaped flange 1604. The flange 1602 has a nail receiving hole 1606 and a slot 1610 which extends into the U-shaped flange 1604. As seen best in FIG. 26, the slot 1610 is T-shaped with the head of the T lying in the bottom of the U-shaped flange 1604.

The wire 1700 has a T-shaped head 1702 which is dimensioned to fit through the slot 1610 and be rotated into the position shown in FIG. 25. As seen best in FIG. 27, the head 1702 of the wire 1700 is formed by six ninety degree bends in the wire resulting in the wire doubling against itself below the head. This double width fits into the head of the T-shaped slot 1610 when the wire is rotated into the position shown in FIG. 25. From the foregoing, those skilled in the art will appreciate that the wire and bracket are assembled by rotating the wire to the position shown in FIG. 27 and inserting it through the slot 1610 until the double width below the head 1702 clears the slot, rotating the wire ninety degrees and lowering it to the position shown in FIG. 25.

There have been described and illustrated herein several embodiments of methods and apparatus for suspending fixtures. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

The invention claimed is:

1. An apparatus for suspending a fixture from a mounting surface, said apparatus comprising:

a bracket having a first flange and a second flange, said first flange having a first surface and defining a first hole adapted to receive a fastener to fasten said bracket with said first surface abutting the mounting surface, said second flange defining a second hole;

a wire having a first end and a second end, said first end being adapted to couple to the fixture, said second end being adapted to mate with said second flange of said bracket by inserting said second end either vertically upward or horizontally through said second hole, rotating said wire, and pulling it downward such that said wire engages said second flange and is prevented from moving downward.

2. An apparatus according to claim 1, wherein:

said second hole is a T-shaped slot and said second end of said wire is T-shaped.

3. An apparatus according to claim 1, wherein:

said second hole is two holes and said second end of said wire is substantially C-shaped.

4. An apparatus according to claim 1, wherein:

said second end of said wire is substantially Z-shaped.

5. The apparatus according to claim 4, wherein:

said second flange includes a hook, and said second end of said wire forms a loop adapted to engage said hook.

* * * * *